US010475428B2

(12) United States Patent
Ruchert

(10) Patent No.: US 10,475,428 B2
(45) Date of Patent: Nov. 12, 2019

(54) ELECTRONIC MEASURING DEVICE

(71) Applicant: MULTIPITCH INC., San Jose, CA (US)

(72) Inventor: Clemens Ruchert, Neu-Anspach (DE)

(73) Assignee: Multipitch Inc., San Jose, CA (US)

( * ) Notice: Subject to any disclaimer, the term of this patent is extended or adjusted under 35 U.S.C. 154(b) by 0 days.

(21) Appl. No.: 15/761,065

(22) PCT Filed: Sep. 15, 2016

(86) PCT No.: PCT/US2016/051995
§ 371 (c)(1),
(2) Date: Mar. 16, 2018

(87) PCT Pub. No.: WO2017/048998
PCT Pub. Date: Mar. 23, 2017

(65) Prior Publication Data

US 2018/0277083 A1 Sep. 27, 2018

Related U.S. Application Data

(60) Provisional application No. 62/220,657, filed on Sep. 18, 2015.

(51) Int. Cl.

| | |
|---|---|
| ***G10G 7/02*** | (2006.01) |
| ***G10H 1/44*** | (2006.01) |
| *G10L 21/14* | (2013.01) |

(52) U.S. Cl.
CPC ..... *G10H 1/44* (2013.01); *G10G 7/02* (2013.01); *G10H 2210/066* (2013.01); *G10H 2250/031* (2013.01); *G10L 21/14* (2013.01)

(58) Field of Classification Search
CPC ..... G10H 1/44; G10G 7/02
See application file for complete search history.

(56) References Cited

U.S. PATENT DOCUMENTS

| | | | | |
|---|---|---|---|---|
| 4,498,363 A * | 2/1985 | Shimada | ..... | G10H 5/06 84/451 |
| 4,803,908 A | 2/1989 | Skinn et al. | | |
| 5,773,737 A | 6/1998 | Reyburn | | |
| 5,824,929 A | 10/1998 | Freeland et al. | | |

(Continued)

FOREIGN PATENT DOCUMENTS

CN 101793873 B 1/2013

OTHER PUBLICATIONS

Dirk's Piano Tuner v4.0, viewed at https://www.dirksprojects.nl/index.php?Lan=english&Page=Tuner/piano_tuner_40.php 2010.*

(Continued)

*Primary Examiner* — Robert W Horn
(74) *Attorney, Agent, or Firm* — Lowenstein Sandler LLP

(57) ABSTRACT

An electronic measuring device captures a plurality of audio samples, wherein each audio sample corresponds to a different string of a musical instrument. The device further identifies a plurality of frequency components of each of the plurality of audio samples, calculates an optimal tuning curve based on the plurality of frequency components of each of the plurality of audio samples, and determines a deviation of the plurality of frequency components of each of the plurality of audio samples from the optimal tuning curve.

17 Claims, 8 Drawing Sheets

(56) References Cited

U.S. PATENT DOCUMENTS

| | | | | |
|---|---|---|---|---|
| 5,977,467 | A | 11/1999 | Freeland et al. | |
| 6,084,167 | A | 7/2000 | Akimoto et al. | |
| 6,448,487 | B1 * | 9/2002 | Smith | G10H 1/20 84/609 |
| 6,529,843 | B1 | 3/2003 | Carpenter | |
| 6,995,311 | B2 | 2/2006 | Stevenson | |
| 7,064,261 | B2 | 6/2006 | Shao | |
| 7,268,286 | B2 * | 9/2007 | Carpenter | G10G 7/02 702/75 |
| 7,521,618 | B2 * | 4/2009 | Okuyama | G10G 7/02 84/454 |
| 7,928,306 | B2 | 4/2011 | Lemons | |
| 8,022,284 | B1 * | 9/2011 | Velez Medicis | G10H 1/14 84/454 |
| 8,373,053 | B2 * | 2/2013 | Nielsen | G10G 7/02 84/454 |
| 9,076,416 | B2 * | 7/2015 | Nielsen | G10G 7/02 |
| 2006/0288850 | A1 | 12/2006 | Okuyama | |
| 2007/0079688 | A1 | 4/2007 | Okuyama et al. | |
| 2007/0084330 | A1 * | 4/2007 | Okuyama | G10G 7/02 84/454 |
| 2008/0270904 | A1 | 10/2008 | Lemons et al. | |
| 2013/0145921 | A1 * | 6/2013 | Ribner | G10G 7/02 84/454 |
| 2014/0060289 | A1 | 3/2014 | Hirshberg | |
| 2018/0277083 | A1 * | 9/2018 | Ruchert | G10G 7/02 |

OTHER PUBLICATIONS

International Search Report and Written Opinion for PCT Application No. PCT/US2016/051995, dated Nov. 29, 2016, 7 pages.

Bachmann et al., "Prisma—A Timbre Tuning Device for Musicians and Instrument Makers", http://www.prisma-music.ch/downloads/isma2007prismapaper.pdf, ISMA 2007, 8 pages.

Kageyama, Noa, "Five Best Tuner Apps—The Bulletproof Musician", http://www.bulletproofmusician.com/five-best-tuner-apps/, retreived on Mar. 19, 2019, 12 pages.

Hartquist, John, "Real-Time Musical Analysis of Polyphonic Guitar Audio", http://digitalcommons.calpoly.edu/cgi/viewcontent.cgi?article=1853&context=these, Jun. 2012, 55 pages.

European Extended Search Report for EP Application No. EP16847333, dated Apr. 3, 2019, 7 pages.

* cited by examiner

ELECTRONIC MEASURING DEVICE

BACKGROUND

Tuning a stringed musical instrument includes the act of making minute adjustments to the tensions of the strings to properly align the intervals between their tones so that the instrument is in tune. Many factors can cause these instruments to go out of tune over time, particularly atmospheric changes. For instance, changes in humidity can affect the pitch of an instrument. An out-of-tune instrument can often be identified by the characteristic beating sound it produces. This fluctuation in the sound intensity may be a result of two or more tones, containing similar frequencies, played together. Fine tuning includes an assessment of the vibration interaction among notes, which may be different for every instrument, and thus in practice involves matching the notes to slightly different pitches from any theoretical standard.

BRIEF DESCRIPTION OF THE DRAWINGS

The present disclosure is illustrated by way of example, and not by way of limitation, in the figures of the accompanying drawings.

DETAILED DESCRIPTION

Embodiments are described for an electronic measuring device. One application of the device is for tuning of musical instruments, such as a piano, harpsichord, or other string instrument. A vibrating string produces vibrations at a number of frequencies above the fundamental pitch of the corresponding note. These vibrations may be referred to as overtones, or as harmonics when the overtones are at integer multiples (e.g., 2×, 3× . . . 6× . . . ) of the fundamental frequency. When multiple notes are played together, or at least when multiple strings of the instrument are vibrating simultaneously, an interference among the harmonic frequencies of the multiple notes may cause a beating effect (i.e., a disturbing perceived fluctuation in the sound intensity). The beating occurs when the harmonic frequencies of multiple notes are close to one another, but slightly different.

In one embodiment, the electronic measuring device described herein assists in the tuning of the music instrument by calculating the difference between the harmonic frequencies of each string and providing feedback based on those calculations. The electronic measuring device (also referred to herein as a "tuning device") utilizes a mathematical model that describes the beating of arbitrarily combined strings after each string's individual properties are recorded. In one embodiment, operation of the tuning device is divided in to two stages. The first stage includes a recording of the instrument's initial acoustic properties. During this stage, the tuning device captures and records a waveform for each individual string of the instrument. All information used by the device is based on the acoustic waveforms generated by the musical instrument, which may be captured with a microphone or other acoustic signal capture device. The second stage includes a tuning procedure, during which each string is tuned individually. During both stages multiple frequency components of each note are taken into account.

Figure 1:
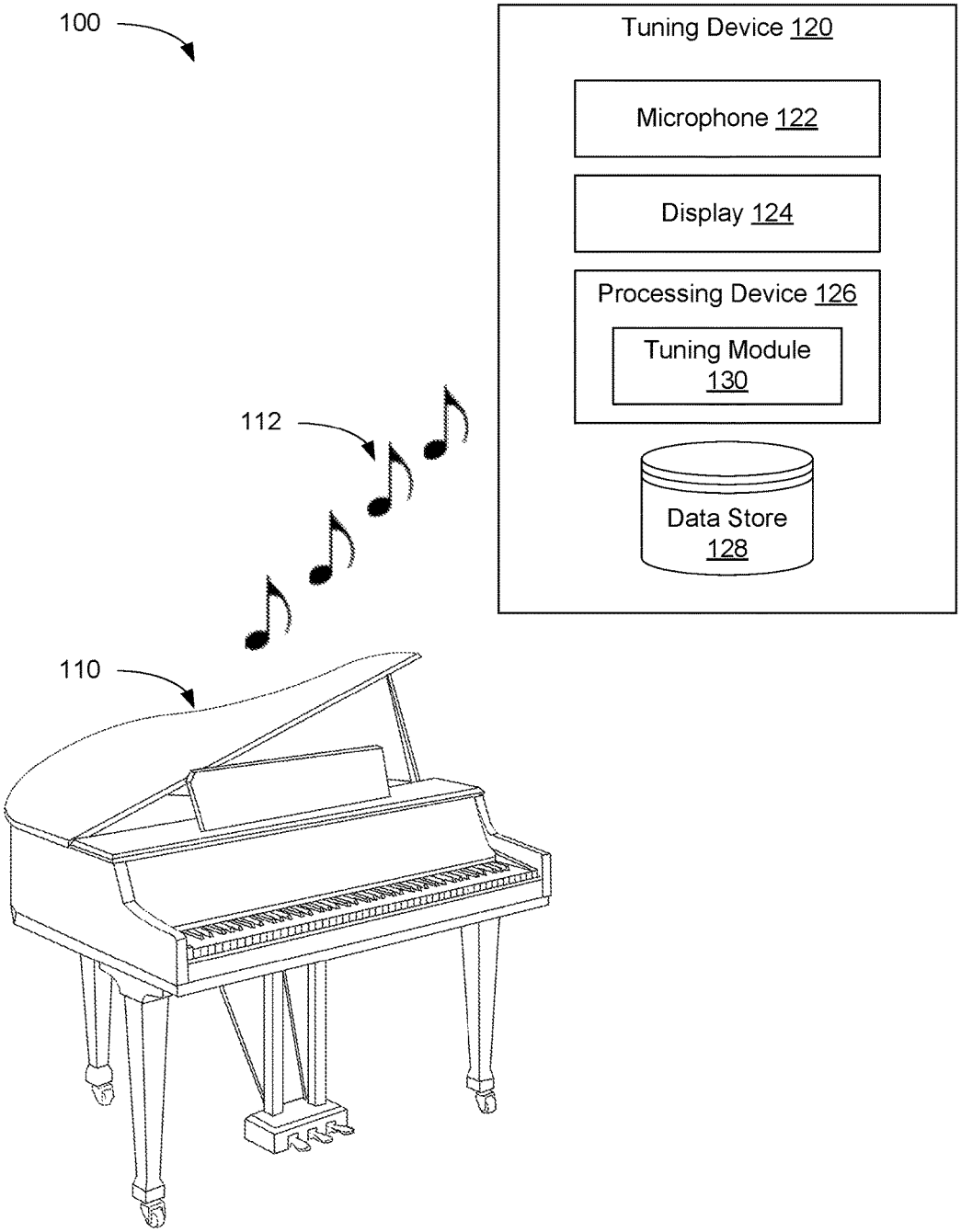
FIG. 1 is a block diagram illustrating a tuning environment in which embodiments of the present disclosure may be implemented.

FIG. 1 is a block diagram illustrating a tuning environment 100 in which embodiments of the present disclosure may be implemented. In one embodiment, tuning environment 100 includes instrument 110 and tuning device 120. Instrument 110 may be a string instrument designed to produce sound from vibrating strings. Instrument 110 may include a plurality of strings of different lengths, gauges, and/or materials, each designed to produce a different note. In one embodiment, the strings may be struck to induce vibration and produce the corresponding sound. In other embodiments, the strings may be plucked, bowed or otherwise excited to produce the vibration. Examples of instrument 110 may include a piano, a harpsichord, a clavichord, a guitar, a violin, a harp, a cello, a banjo, or any other string instrument. The vibrating strings of instrument 110 produce sound 112 including an acoustic waveform at a fundamental frequency corresponding to the played note, as well as other harmonic frequencies above the fundamental frequency. These waveforms can be captured and analyzed by tuning device 120, as described in detail below. In one embodiment, tuning device 120 is capable of tuning frequencies in a range of approximately 35 Hz-20 kHz.

Figure 8:
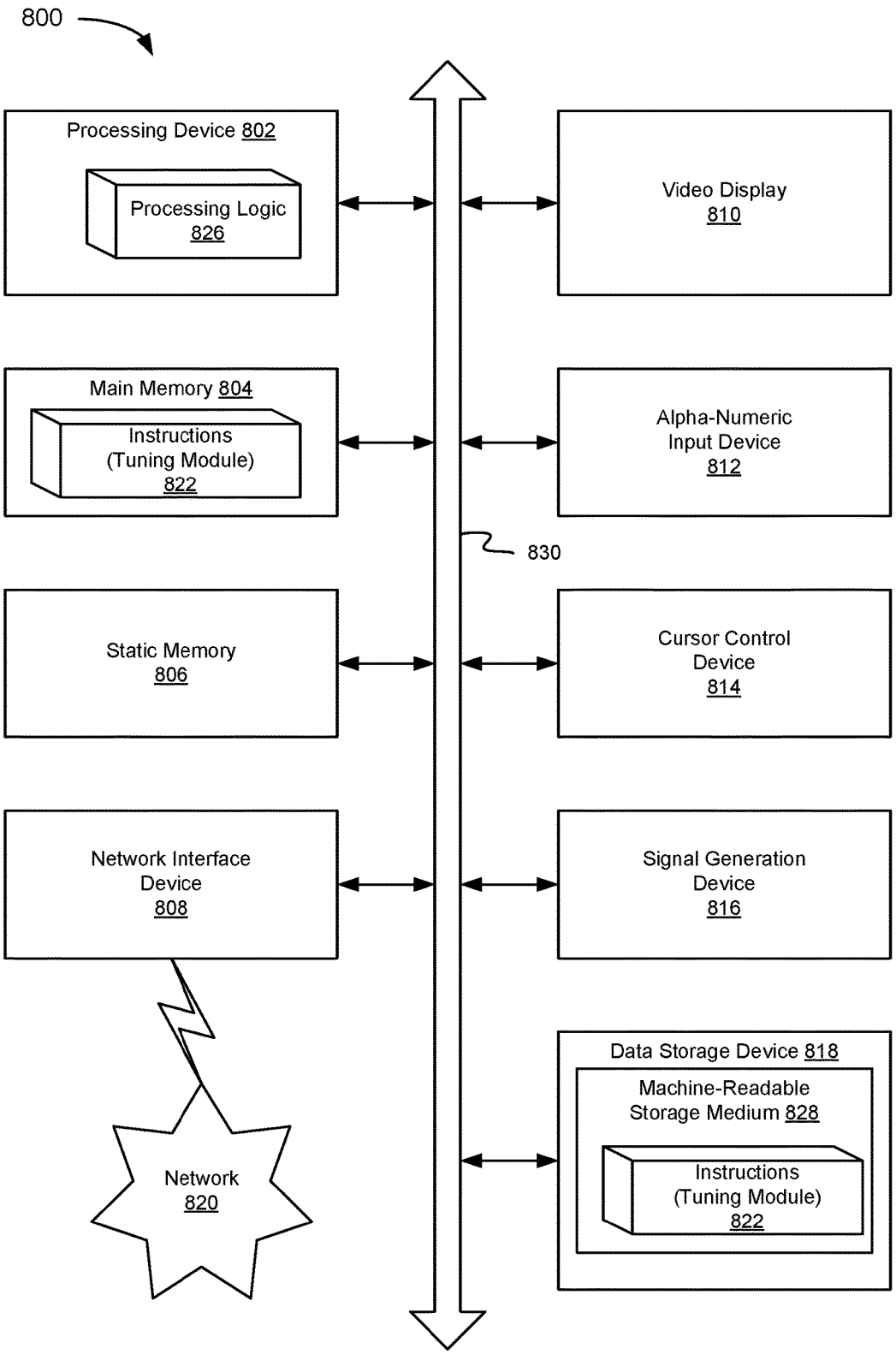
FIG. 8 is a block diagram illustrating an exemplary computer system, according to an embodiment.

In one embodiment, tuning device 120 is a dedicated hardware device, based on micro-controller technology, and is fully functional by itself for standalone application. In this embodiment, no additional hardware such as a computer or other hand-held device is needed. In another embodiment, the functionality of tuning device 120 described herein may be implemented on some other general-purpose device, such as a desktop personal computer (PC), server, workstation, laptop, handheld computer, personal digital assistant (PDAs), smart phone, and so forth. FIG. 8 and the accompanying description describe one possible implementation of tuning device 120.

In either embodiment, tuning device 120 includes a microphone 122, a display device 124, a processing device 126 and a data store 128. In one embodiment, microphone 122 may be configured to capture a plurality of audio samples, including for example, the sounds 112 produced by the vibrating strings of instrument 110. Microphone 122 may include a transducer that converts the sounds 112 into an electrical signal which can be further processed by tuning device 120. For example, microphone 122 may use electromagnetic induction, capacitance change, piezoelectricity, or some other technology to produce the electrical signal from air pressure variations associated with the sounds 112.

Display device 124 may be configured to present a visual output of tuning device 120 for view by a user. In one embodiment, display device 124 may include a liquid crystal display (LCD) device or a cathode ray tube (CRT) display device. In one embodiment, display device 124 may include a stroboscopic display designed to display the sonic level and the calculated beating of the harmonic frequencies on a bar-graph display. The display may present a visual phenomenon known as the "stroboscopic effect" caused by aliasing that occurs when continuous motion is represented by a series of short or instantaneous samples. This effect occurs when the view of a moving bar graph is represented by a series of short samples as distinct from a continuous view, and the moving bar graph is in cyclic motion at a rate close to the sampling rate.

In one embodiment, tuning device 120 includes one or more processing devices 126, each comprising one or more processor cores. Each processor core includes circuitry for executing instructions according to a predefined general-purpose instruction set. For example, the x86 instruction set architecture may be selected. Alternatively, the ARM®, Alpha®, PowerPC®, SPARC®, or any other general-purpose instruction set architecture may be selected. The processor cores may access cache memory subsystems for data and computer program instructions. The cache subsystems may be coupled to a memory hierarchy comprising random access memory (RAM) and a storage device. In one embodiment, data store 128 may include one or more mass storage devices which can include, for example, flash memory, magnetic or optical disks, or tape drives; read-only memory (ROM); random-access memory (RAM); erasable programmable memory (e.g., EPROM and EEPROM); flash memory; or any other type of storage medium.

In one embodiment, processing device 126 executes tuning module 130 to perform the various operations described herein. For example, tuning module 130 may instruct microphone 122 to capture a plurality of audio samples of sound 112 and store those audio samples in data store 128. Tuning module 130 may further identify a plurality of frequency components (including the fundamental frequency and one or more harmonic frequencies) of each of the plurality of audio samples and then calculate an optimal tuning curve based on those frequency components. The optimal tuning curve may define certain tuning parameters (e.g. frequencies) designed to reduce an audible beating effect when two or more strings of instrument 110 are excited simultaneously. The optimal tuning curve may seek to define frequencies where the harmonic frequency components corresponding to different strings of instrument 110 overlap in order to reduce or eliminate the beating effect. Tuning module may further determine a deviation of the frequency components for a given string from the optimal tuning curve and may cause display of an indication of this deviation on display device 124. A user of tuning device 120 can view the displayed indication and utilize that feedback to perform a tuning adjustment on instrument 110, such as adjusting the tension of a particular string. Additional details of the operation of tuning module 130 are provided below with respect to FIGS. 2-7.

Figure 2:
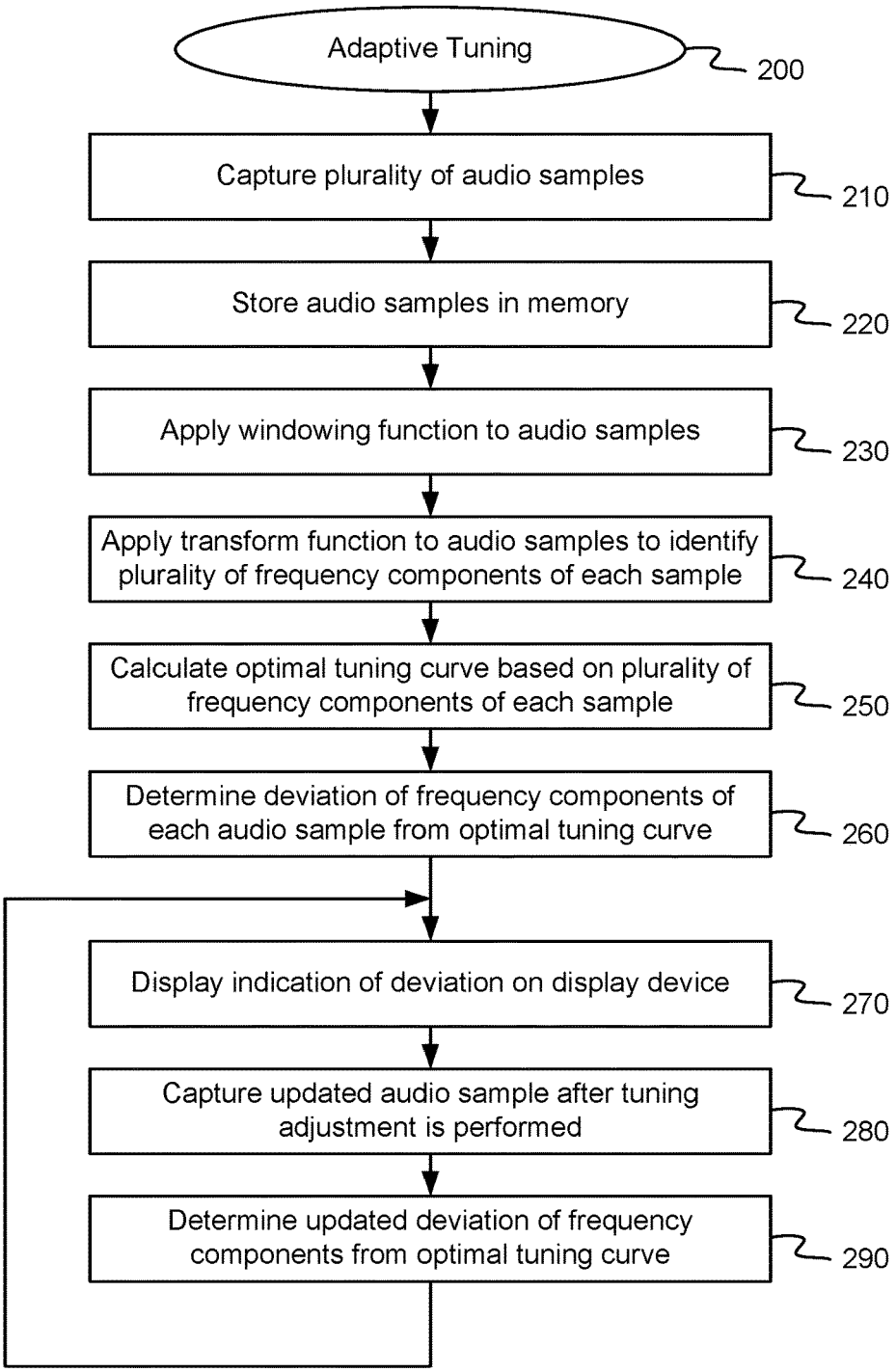
FIG. 2 is a flow diagram illustrating a method for adaptive tuning, according to an embodiment.

FIG. 2 is a flow diagram illustrating a method 200 for adaptive tuning, according to an embodiment. The method 200 may be performed by processing logic that comprises hardware (e.g., circuitry, dedicated logic, programmable logic, microcode, etc.), software (e.g., instructions run on a processing device to perform hardware simulation), or a combination thereof. The method 200 can account for multiple frequency components of a single note when comparing those frequency components to those of another note in order to reduce or eliminate a beating effect during a tuning operation. In one embodiment, method 200 may be performed by tuning module 130 of tuning device 120, as shown in FIG. 1.

Referring to FIG. 2, at block 210, method 200 captures a plurality of audio samples, wherein each audio sample corresponds to a different string of musical instrument 110. In one embodiment, a user of tuning device 120 manually excites each individual string of instrument 110. In the case of a piano, this may include pressing a key on the keyboard of the piano which causes a corresponding hammer to strike one of the strings. As a result the string will vibrate producing an acoustic waveform at a fundamental frequency corresponding to the played note, as well as other harmonic frequencies above the fundamental frequency. In one embodiment, microphone 122 can capture a separate audio sample corresponding to each note (i.e., each string of instrument 110.) In one embodiment, tuning module 130 initiates a recording in response to a user input, captures the audio sample, and terminates the recording process. Tuning module 130 may repeat this process for each string of the instrument 110. In the case of a piano, tuning module 130 may capture 88 audio samples (i.e., one sample corresponding to each key/string).

At block 220, method 200 stores the plurality of audio samples in data store 128. In one embodiment, upon capturing each audio sample at block 210, tuning module 130 stores the audio sample in data store 128. In one embodiment, tuning module 130 may add each audio sample to an entry corresponding to a particular key/string of instrument 110. In one embodiment, the audio sample data may be stored as part of a profile data associated with the particular instrument 110. This profile data may be saved indefinitely in data store 128 so that historical data can be accessed in the future. Depending on the embodiment, various data structures can be used to implement the data store 128, such as for example, a circular data buffer, ring buffer or other first-in, first-out structure.

Figure 4A:
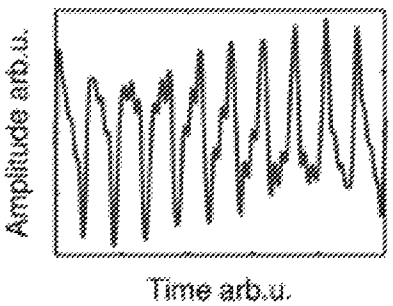
FIGS. 4A-B are graphs illustrating the individual frequency components of an acoustic waveform, according to an embodiment.
Figure 4B:
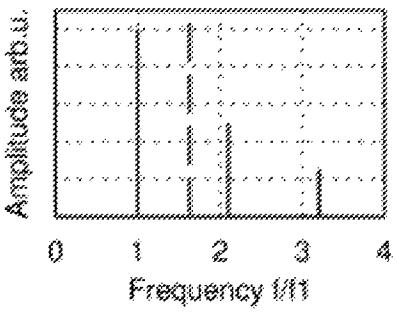

At block 230, method 200 applies a windowing function to the plurality of audio samples captured at block 210. In one embodiment, tuning module 130 accesses data store 128 and copies at least a portion of the buffer into a window for spectral analysis using, for example, the Fast Fourier Transform algorithm. FIG. 4A illustrates one example of an input acoustic waveform. FIG. 4B illustrates the inharmonicity of the three different frequencies (i.e., the fundamental frequency and two harmonic frequencies) after the transform function has been applied as described above. The dotted line in FIG. 4B represents a weighted mean frequency of the three frequencies based on amplitude.

Depending on the effective frequency content of the note being tuned a different temporal window size may be utilized to reach a constant accuracy of the tuning device 120. In one embodiment, this is realized with a window size covering a constant number of oscillations for the lowest present frequency. A response constant $n_{osc}$ representing the number of oscillations of the device can be adjusted to the environmental needs. For low noise environments, a smaller response constant can be chosen to ensure a fast response. In situations with high background noise, however, a higher response constant can be chosen to effectively suppress uncorrelated short-time background noise.

In one embodiment, the routine is optimized to achieve a minimum sine wave measuring accuracy of ±0.05 Ct over a frequency range f within $f_{min}$ to $f_{max}$ [Hz] with a response window of 10 to 150 number of oscillations $n_{osc}$. The value of $f_{min}$ may be limited by the recording duration while $f_{max}$ is limited by the sampling rate of the device. Prior to display of the result the response time is $t=n_{osc}/f_{low}$ [seconds]. In one embodiment, $f_{low}$ is the lowest present frequency for the active note.

Figures 3A, 3B, 3C, 3D, 3E, 3F:
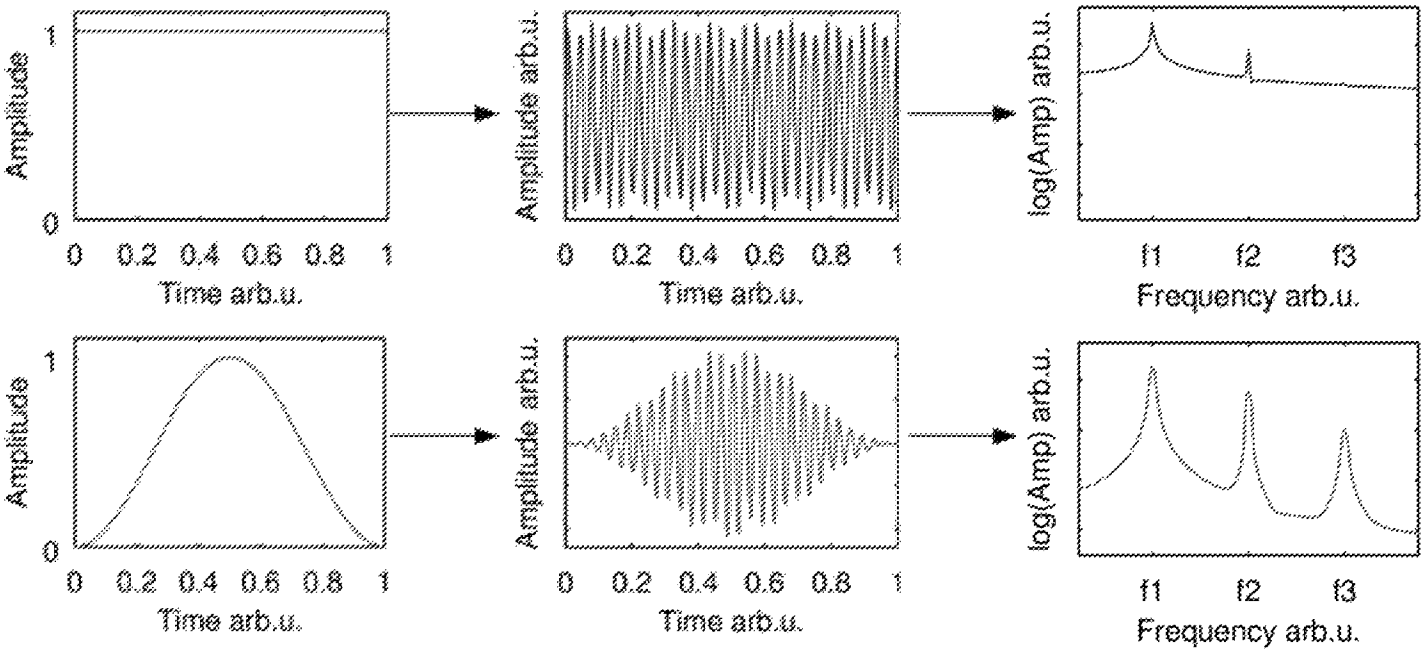
FIGS. 3A-F are graphs illustrating the application of various window functions to acoustic waveforms, according to an embodiment.

Truncation of the audio data to this response time can influence the spectral analysis significantly. An uncontrolled transition from the end of the window to the beginning can lead to a jump due to the periodicity introduced by the Fast Fourier Transform algorithm. This effect is illustrated in FIGS. 3A-F. FIG. 3A illustrates one example of a rectangular window function. FIG. 3B illustrates the rectangular window function applied to a certain audio waveform corresponding to one of the strings of instrument 110. The rectangular window function allows at least two frequencies $f_1$ and $f_2$ (e.g., the fundamental frequency and a first harmonic frequency) to be resolved, as shown in FIG. 3C. A third frequency $f_3$ (e.g., a second harmonic frequency), however, is covered in the noise generated from the windowing effect. This effect can be minimized by choosing a non-rectangular window function. FIG. 3D illustrates one example of a suitable window, which is the Hanning window where:

$$\mathrm{Amp}(t) = 0.5 - 0.5 \cdot \cos\left(2\pi \frac{t}{t_{width}}\right) (0 \le t \le t_{width}),$$

$$\mathrm{Amp}(t) = 0 \ \ (t < 0 \vee t > t_{width})$$

FIG. 3E illustrates the Hanning window function applied to the audio waveform. With the Hanning window all three frequencies $f_1$, $f_2$ and $f_3$ can be resolved, as shown in FIG. 3F. As a tradeoff, this increase in relative spectral amplitude resolution is coupled to a decreasing frequency resolution. This means that the Hanning window can to be chosen wider than a rectangular window in order to achieve the same frequency accuracy. It is worth noting that the windowing effect is not valid for signals narrower than the width of the window.

Referring again to FIG. 2, at block 240, method 200 identifies a plurality of frequency components of each of the plurality of audio samples. In one embodiment, tuning module 130 applies a transform function (e.g., the Fast Fourier Transform) to the plurality of audio samples to identify the plurality of frequency components. A mathematical model describes properties of an individual string of the instrument being tuned, taking into account a spectral energy envelope and inharmonicity. The individual frequency components of each note form the harmonic content and are the base for the natural intervals. The inharmonicity describes the deviation of the harmonic content $f_n \neq n \cdot f_1$ ($n>1$, $n \in IN$) from the integer multiples n times the fundamental frequency $f_1$ [Hz] as shown in FIG. 3*b*. The unit of the deviation Dev is defined to be [Ct]. Ct is a relative measure defined as the $1200^{th}$ root of a factor of 2. The factor of 2 corresponds to the span of an octave. Therefore, 1 Ct corresponds to a factor of $$fac_{Ct} = \sqrt[1200]{2}.$$

The deviation can be described as:

$$Dev = \sum_n inharm_n \cdot f^n.$$

Measurements showed that reducing the inharmonicity to the second order effect $\mathrm{inharm}=\mathrm{inharm}_2$ and, therefore, a deviation of $\mathrm{Dev}=\mathrm{inharm} \cdot f^2$ may be suitable for most situations. The unit of inharm then is defined to be $\mathrm{Ct/Hz}^2$. Based on this model the frequencies $f_n$ can be described as shown below:

$$f_n = f_{ni} \cdot \mathrm{fac}_{Ct}^{Dev} (n \ge 1, n \in IN)$$

$$f_{ni} = n \cdot f_{1i} (n \ge 1, n \in IN)$$

$$\mathrm{Dev} = \mathrm{inharm} \cdot f_{ni}^2$$

All frequency components of a single string may be described by their harmonic order $n \ge 1$, $n \in IN$, the idealized fundamental frequency $f_{1i}$, and the inharmonicity inharm as shown above.

Calculating the value of inharm from a pair of two measured $f_n$ describes an equation system. This system is solved and used by the algorithm to retrieve the inharmonicity and $f_{1i}$ from the measured frequency components. The value n needs to be retrieved for each $f_n$ from the low frequency content and might be simplified by a user-specified note value. The value $\mathrm{inharm}_{eff}$ which is used by the device to calculate the ideal tuning curve is an effective value retrieved from at least one pair of strong harmonics monitored over time. The spectral energy envelope shape is accounted for by the position of the spectral mean of the individual spectral components. The model includes several frequency components for each note.

TABLE 1

Main interval Structure

| Interval | n1 | n2 | fn2/fn1 | Ct |
|---|---|---|---|---|
| Octave | 1 | 2 | 2 | 1200 |
| Fifth | 2 | 3 | 3/2 | 702 |
| Fourth | 3 | 4 | 4/3 | 498 |
| Third | 4 | 5 | 5/4 | 386 |

Most instruments with 12 intervals per octave can be tuned by this device. Based on the harmonic content of each note, the main four intervals are optimized in terms of beating. The main intervals without the effect of inharmonicity are shown in Table 1. With a step of 100 Ct per interval the octave is a step of 1200 Ct which corresponds to a factor of 2.

TABLE 2

Measurement example $f_n$ for Piano A4 string

| | n | | | | | |
|---|---|---|---|---|---|---|
| | 1 | 2 | 3 | 4 | 5 | 6 |
| $f_n$ [Hz] | 440.00 | 880.97 | 1323.90 | 1769.76 | 2219.56 | 2674.29 |
| $f_{ni} = n \cdot f_{1i}$ [Hz] | 439.84 | 879.68 | 1319.51 | 1759.35 | 2199.19 | 2639.03 |
| Dev [Ct] | 0.64 | 2.55 | 5.75 | 10.21 | 15.96 | 22.98 |
| $\mathrm{inharm}_{eff}$ [$\mathrm{Ct/Hz}^2$] | | | $3.3 \cdot 10^{-6}$ | | | |

Due to inharmonicity, the natural intervals are larger than the values given in Table 1. Taking this effect into account when tuning the instrument is often described as stretched tuning. As a next step, the tuning curve is optimized by minimizing the low frequency beating of the main four intervals. An example for a possible measurement of a piano A4 string with $f_n$, the retrieved idealized fundamental frequency $f_{1i}$ and effective inharmonicity $\mathrm{inharm}_{eff}$ is shown in Table 2.

Figure 5A:
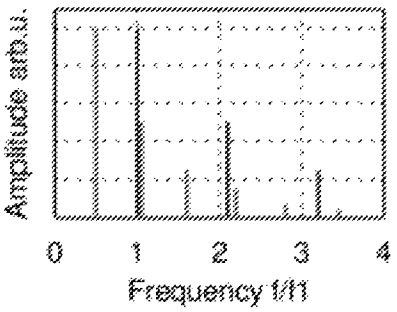
FIGS. 5A-B are graphs illustrating the individual frequency components of an acoustic waveform, according to an embodiment.
Figure 5B:
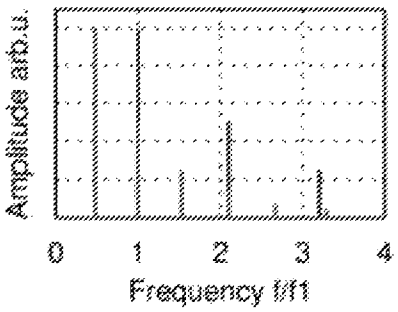

Referring again to FIG. 2, at block 250, method 200 calculates an optimal tuning curve based on the plurality of frequency components of each of the plurality of audio samples. In one embodiment, the optimal tuning curve defines a frequency where a first harmonic frequency component of a first string overlaps a second harmonic frequency component of a second string. In one embodiment, the optimal tuning curve defines tuning parameters to reduce an audible beating effect when two or more strings of the musical instrument 110 are excited simultaneously. In one embodiment, the optimal tuning curve is calculated based on the instrument's individual properties. This is realized by minimizing the theoretical audible beating for the main four intervals; these are octave, fifth, fourth, and third interval. During the first iterations the stretch is calculated. The following iterations lead to the ideal position for each note by successively increasing the precision of the algorithm. As shown in FIG. 5A, the harmonic frequencies of any two randomly selected strings may be offset from one another. In this case, the graph illustrates the harmonic frequencies of a first input waveform and that of a string one octave below. The offset in harmonic frequencies can result in the unpleasant beating effect. The optimal tuning curve attempts to define idealized positions of all frequency components for each key of the instrument such that the harmonic frequencies will at least partially overlap, as shown in FIG. 5B. One of skill in the art would note that although the third frequencies for each waveform in FIG. 5B do not directly overlap, the amplitude of these signals is low enough to prevent any significant effect.

Figure 6B:
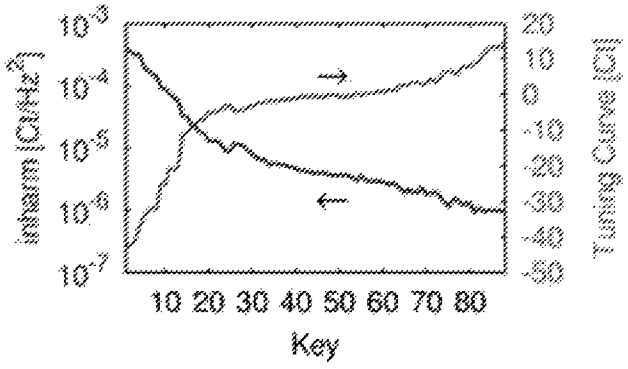
FIGS. 6A-B are graphs illustrating the mean frequency and harmonic measurements for an instrument and a resulting optimized tuning curve, according to an embodiment.
Figure 6A:
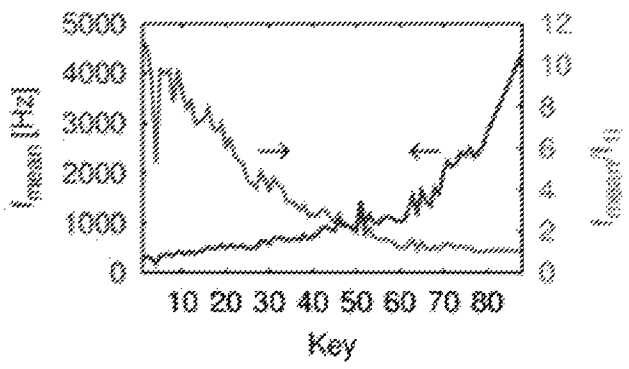

FIGS. 6A-B illustrate the mean frequency and inharmonicity from instrument 110. In one embodiment, the strength of the harmonic content for each string is indicated by the value of the mean harmonic $f_{mean}/f_{1i}$, as shown in FIG. 6A. A value of the mean harmonic which is large compared to 1 means that frequencies other than the fundamental frequency are relevant, while a value smaller than 1.5 indicates that the fundamental frequency is dominant. The resulting tuning curve is shown in FIG. 6B. The Ct value corresponds to the value of $f_{1i}$ and may not be directly related to the fundamental frequency $f_1$.

Figure 7A:
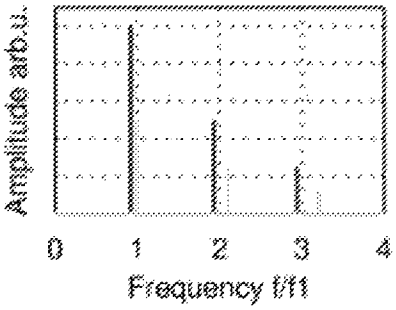
FIGS. 7A-B are graphs illustrating a deviation in frequency from an optimized tuning curve, according to an embodiment.
Figure 7B:
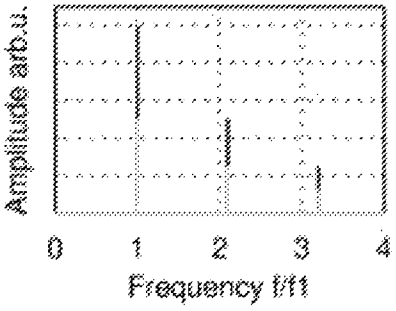

Referring again to FIG. 2, at block 260, method 200 determines a deviation of the plurality of frequency components of each of the plurality of audio samples from the optimal tuning curve. The optimized tuning curve represents an ideal position for each of the harmonic frequencies in order to reduce or eliminate the beating effects. In certain embodiments, it may be the case that the present location of those frequencies does not exactly match the ideal positions defined by the tuning curve. FIG. 7A illustrates one potential deviation for the harmonic frequencies of a particular string. FIG. 7B illustrates the optimized spectrum showing how the frequencies would overlap when properly tuned according to the optimized tuning curve. The calculated deviation of each harmonic from FIG. 7A can be used as feedback provided to the user in order to achieve the state illustrated in FIG. 7B.

Referring again to FIG. 2, at block 270, method 200 causes display of an indication of the deviation on display device 124. Display device 124 may be configured to present a visual output of tuning device 120 for view by a user. In one embodiment, tuning module 130 causes presentation of a stroboscopic output on display device 124. In one embodiment, the display may include one or more bar graphs that display a "stroboscopic effect" to represent a level of beating attributable to the deviation of the frequency components of a particular string from the optimized tuning curve. In addition, the display may include a numerical representation of the deviation and/or an indication of a tuning adjustment to be performed in order to decrease or eliminate the deviation.

At block 280, method 200 captures an updated audio sample corresponding to a first string of musical instrument 110 after a tuning adjustment is performed on the first string. In response to viewing the display information presented at block 270, the user may take some action to make a tuning adjustment on instrument 110. For example, the user may adjust the tension of the string using techniques well known to those of skill in the art. After making the tuning adjustment, the user may again excite the first string, and microphone 122 may capture an updated audio sample. In one embodiment, tuning module 130 may store this updated audio sample in data store 128. The constant monitoring of the instrument's data ensures adaptation of the tuning curve to changing properties of the instrument due to environmental changes or other influences, such as pitch change.

At block 290, method 200 determines an updated deviation of a plurality of frequency components of the updated audio sample from the optimal tuning curve. In one embodiment, tuning module 130 compares the updated positions of the harmonic frequencies after tuning to the ideal positions defined in the optimal tuning curve. If further deviation remains, method 200 may return to block 270 and present additional feedback to the user. These operations may be repeated until the deviation for the current string is eliminated or minimized below some defined threshold. In addition, these operations may be performed for each key/string/note of musical instrument 110 until the deviations of each harmonic frequency from the optimized tuning curve are eliminated or minimized below the threshold.

FIG. 8 illustrates a diagrammatic representation of a machine in the exemplary form of a computer system 800 within which a set of instructions, for causing the machine to perform any one or more of the methodologies discussed herein, may be executed. In alternative embodiments, the machine may be connected (e.g., networked) to other machines in a LAN, an intranet, an extranet, or the Internet. The machine may operate in the capacity of a server machine in client-server network environment. The machine may be a personal computer (PC), a set-top box (STB), a server, a network router, switch or bridge, or any machine capable of executing a set of instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein. In one embodiment, computer system 800 may represent tuning device 120 of FIG. 1.

The exemplary computer system 800 includes a processing device (processor) 802, a main memory 804 (e.g., read-only memory (ROM), flash memory, dynamic random access memory (DRAM) such as synchronous DRAM (SDRAM)), a static memory 806 (e.g., flash memory, static random access memory (SRAM)), and a data storage device 818, which communicate with each other via a bus 830.

Processing device 802 represents one or more general-purpose processing devices such as a microprocessor, central processing unit, or the like. More particularly, the processing device 802 may be a complex instruction set computing (CISC) microprocessor, reduced instruction set computing (RISC) microprocessor, very long instruction word (VLIW) microprocessor, or a processor implementing other instruction sets or processors implementing a combination of instruction sets. The processing device 802 may also be one or more special-purpose processing devices such as an application specific integrated circuit (ASIC), a field programmable gate array (FPGA), a digital signal processor (DSP), network processor, or the like. The processing device 802 is configured to execute tuning module 130 to perform the adaptive tuning as described herein.

The computer system 800 may further include a network interface device 808. The computer system 800 also may include a video display unit 810 (e.g., a liquid crystal display (LCD) or a cathode ray tube (CRT)), an alphanumeric input device 812 (e.g., a keyboard), a cursor control device 814 (e.g., a mouse), and a signal generation device 816 (e.g., a speaker).

The data storage device 818 may include a computer-readable medium 828 on which is stored one or more sets of instructions 822 (e.g., instructions of tuning module 130) embodying any one or more of the methodologies or functions described herein. The instructions 822 may also reside, completely or at least partially, within the main memory 804 and/or within processing logic 826 of the processing device 802 during execution thereof by the computer system 800, the main memory 804 and the processing device 802 also constituting computer-readable media. The instructions may further be transmitted or received over a network 820 via the network interface device 808.

While the computer-readable storage medium 828 is shown in an exemplary embodiment to be a single medium, the term "computer-readable storage medium" should be taken to include a single medium or multiple media (e.g., a centralized or distributed database, and/or associated caches and servers) that store the one or more sets of instructions. The term "computer-readable storage medium" shall also be taken to include any medium that is capable of storing, encoding or carrying a set of instructions for execution by the machine and that cause the machine to perform any one or more of the methodologies of the present invention. The term "computer-readable storage medium" shall accordingly be taken to include, but not be limited to, solid-state memories, optical media, and magnetic media.

The preceding description sets forth numerous specific details such as examples of specific systems, components, methods, and so forth, in order to provide a good understanding of several embodiments of the present disclosure. It will be apparent to one skilled in the art, however, that at least some embodiments of the present disclosure may be practiced without these specific details. In other instances, well-known components or methods are not described in detail or are presented in simple block diagram format in order to avoid unnecessarily obscuring the present disclosure. Thus, the specific details set forth are merely exemplary. Particular embodiments may vary from these exemplary details and still be contemplated to be within the scope of the present disclosure.

In situations in which the systems discussed herein collect personal information about users, or may make use of personal information, the users may be provided with an opportunity to control whether programs or features collect user information (e.g., information about a user's social network, social actions or activities, profession, a user's preferences, or a user's current location), or to control whether and/or how to receive content from the media server that may be more relevant to the user. In addition, certain data may be treated in one or more ways before it is stored or used, so that personally identifiable information is removed. For example, a user's identity may be treated so that no personally identifiable information can be determined for the user, or a user's geographic location may be generalized where location information is obtained (such as to a city, ZIP code, or state level), so that a particular location of a user cannot be determined. Thus, the user may have control over how information is collected about the user and used by the web server or media server.

Reference throughout this specification to "one embodiment" or "an embodiment" means that a particular feature, structure, or characteristic described in connection with the embodiments included in at least one embodiment. Thus, the appearances of the phrase "in one embodiment" or "in an embodiment" in various places throughout this specification are not necessarily all referring to the same embodiment. In addition, the term "or" is intended to mean an inclusive "or" rather than an exclusive "or."

Although the operations of the methods herein are shown and described in a particular order, the order of the operations of each method may be altered so that certain operations may be performed in an inverse order or so that certain operation may be performed, at least in part, concurrently with other operations. In another embodiment, instructions or sub-operations of distinct operations may be in an intermittent and/or alternating manner.

What is claimed is:

1. A standalone tuning device comprising:

a memory; and a processing device coupled to the memory, the processing device to:

capture a plurality of audio samples, wherein each audio sample corresponds to a different string of a musical instrument, and wherein the standalone tuning device is applicable to multiple types of musical instruments;

apply a windowing function to the plurality of said audio samples to create windowed data, the windowing function using a temporal window of a certain size, wherein the certain size varies dependent on an effective frequency of a corresponding audio sample of the plurality of audio samples;

apply a transform function to the windowed data to identify a plurality of frequency components;

calculate an optimal tuning curve based on the plurality of frequency components of each of the plurality of audio samples; and determine a deviation of the plurality of frequency components of each of the plurality of audio samples from the optimal tuning curve;

wherein the standalone tuning device is a dedicated hardware device for tuning musical instruments.

2. The standalone tuning device of claim 1, wherein processing device further to:

store the plurality of audio samples in the memory.

3. The standalone tuning device of claim 1, wherein the optimal tuning curve to define a frequency where a first harmonic frequency component of a first string overlaps a second harmonic frequency component of a second string.

4. The standalone tuning device of claim 1, wherein the optimal tuning curve to define tuning parameters to reduce an audible beating effect when two or more strings of the musical instrument are excited simultaneously.

5. The standalone tuning device of claim 1, further comprising:

a display device, wherein the processing device further to cause display of an indication of the deviation on the display device.

6. The standalone tuning device of claim 1, wherein the processing device further to:

capture an updated audio sample corresponding to a first string of the musical instrument after a tuning adjustment is performed on the first string; and determine an updated deviation of a plurality of frequency components of the updated audio sample from the optimal tuning curve.

7. A method comprising:

capturing, by a standalone tuning device, a plurality of audio samples, wherein each audio sample corresponds to a different string of a musical instrument, wherein the standalone tuning device is a dedicated hardware device for tuning musical instruments, and wherein the standalone tuning device is applicable to multiple types of musical instruments;

applying a windowing function to the plurality of said audio samples to create windowed data, the windowing function having using a temporal window of a certain size, wherein the certain size varies dependent on an effective frequency of a corresponding audio sample of the plurality of audio samples;

applying a transform function to the windowed data to identify a plurality of frequency components;

calculating an optimal tuning curve based on the plurality of frequency components of each of the plurality of audio samples; and determining, by a processing device, a deviation of the plurality of frequency components of each of the plurality of audio samples from the optimal tuning curve.

8. The method of claim 7, further comprising:

storing the plurality of audio samples in a memory.

9. The method of claim 7, wherein the optimal tuning curve to define a frequency where a first harmonic frequency component of a first string overlaps a second harmonic frequency component of a second string.

10. The method of claim 7, wherein the optimal tuning curve to define tuning parameters to reduce an audible beating effect when two or more strings of the musical instrument are excited simultaneously.

11. The method of claim 7, further comprising:

causing display of an indication of the deviation on a display of the standalone tuning device.

12. The method of claim 7, further comprising:

capturing an updated audio sample corresponding to a first string of the musical instrument after a tuning adjustment is performed on the first string; and determining an updated deviation of a plurality of frequency components of the updated audio sample from the optimal tuning curve.

13. A non-transitory computer readable storage medium storing instructions, which when executed, cause a processing device to:

capture, by a standalone tuning device, a plurality of audio samples, wherein each audio sample corresponds to a different string of a musical instrument, wherein the standalone tuning device is a dedicated hardware device for tuning musical instruments, and wherein the standalone tuning device is applicable to multiple types of musical instruments;

apply a windowing function to the plurality of said audio samples to create windowed data, the windowing function having using a temporal window of a certain size, wherein the certain size varies dependent on an effective frequency of a corresponding audio sample of the plurality of audio samples;

apply a transform function to the windowed data to identify a plurality of frequency components;

calculate an optimal tuning curve based on the plurality of frequency components of each of the plurality of audio samples; and determine, by the processing device, a deviation of the plurality of frequency components of each of the plurality of audio samples from the optimal tuning curve;

wherein the non-transitory computer readable storage medium is implemented in a standalone tuning device, wherein the standalone tuning device is a dedicated hardware device for tuning musical instruments, and wherein the standalone tuning device is applicable to multiple types of musical instruments.

14. The non-transitory computer readable storage medium of claim 13, wherein the instructions further cause the processing device to:

store the plurality of audio samples in a memory.

15. The non-transitory computer readable storage medium of claim 13, wherein the optimal tuning curve to define a frequency where a first harmonic frequency component of a first string overlaps a second harmonic frequency component of a second string.

16. The non-transitory computer readable storage medium of claim 13, wherein the instructions further cause the processing device to:

cause display of an indication of the deviation on a display of the standalone tuning device.

17. The non-transitory computer readable storage medium of claim 13, wherein the instructions further cause the processing device to:

capture an updated audio sample corresponding to a first string of the musical instrument after a tuning adjustment is performed on the first string; and determine an updated deviation of a plurality of frequency components of the updated audio sample from the optimal tuning curve.

* * * * *